US005556272A

United States Patent [19]

Blasko et al.

[11] Patent Number: 5,556,272

[45] Date of Patent: Sep. 17, 1996

[54] PILOT ASSEMBLY FOR DIRECT FIRED MAKE-UP HEATER UTILIZING IGNITER SURROUNDED BY PROTECTIVE SHROUD

[75] Inventors: Richard G. Blasko, Hubbart, Ohio; Richard A. Mortimer, Mercer, Pa.

[73] Assignee: Thomas & Betts Corporation, Memphis, Tenn.

[21] Appl. No.: 266,064

[22] Filed: Jun. 27, 1994

[51] Int. Cl.[6] ..... F23Q 7/10; F23Q 7/22

[52] U.S. Cl. ..... 431/75; 431/258; 219/270; 126/39 E

[58] Field of Search ..... 219/260–270; 361/264–266; 123/145 A; 431/263, 262, 258, 264, 75, 78, 191, 192, 286; 126/39 E

[56] References Cited

U.S. PATENT DOCUMENTS

| | | | |
|---|---|---|---|
| 1,535,240 | 4/1925 | Morris . | |
| 1,686,051 | 10/1928 | Weber . | |
| 1,887,730 | 11/1932 | MacRae et al. . | |
| 2,003,624 | 6/1935 | Bower . | |
| 2,183,827 | 12/1939 | Thornbery . | |
| 2,384,797 | 9/1945 | Cerney et al. . | |
| 2,386,807 | 10/1945 | Leslie II . | |
| 2,455,207 | 11/1948 | Williams et al. . | |
| 2,480,230 | 8/1949 | Elster . | |
| 2,482,551 | 9/1949 | Korsgren | 431/263 |
| 2,768,677 | 10/1956 | Traver et al. | 431/263 |
| 2,850,084 | 9/1958 | Kunzler | 431/263 |
| 2,967,224 | 1/1961 | Irwin | 431/263 |
| 2,975,828 | 3/1961 | Robson | 431/263 |
| 3,512,909 | 5/1970 | Perkings | 219/270 |
| 3,562,590 | 2/1971 | Mitts et al. . | |
| 3,812,324 | 5/1974 | Faffaelli et al. | 219/553 |
| 3,823,345 | 7/1974 | Mitts et al. | 219/267 |
| 3,938,944 | 2/1976 | Riehl | 431/191 |
| 3,969,656 | 7/1976 | Mitts et al. | 361/266 |
| 4,029,936 | 6/1977 | Schweitzer | 219/267 |
| 4,176,903 | 12/1979 | Cairo et al. | 439/620 |
| 4,207,053 | 6/1980 | Turner et al. | 431/59 |

FOREIGN PATENT DOCUMENTS

| | | | |
|---|---|---|---|
| 294993 | 4/1944 | Switzerland | 431/263 |

*Primary Examiner*—John A. Jeffery
*Attorney, Agent, or Firm*—Michael L. Hoelter; Salvatore J. Abbruzzese

[57] ABSTRACT

A modular ignition assembly for use in a direct fired make-up heater, includes a hot surface igniter disposed adjacent the discharge ports of a pilot tube for providing a pilot flame. The hot surface igniter is surrounded by a tubular shroud for minimizing the effects of cold air and high humidity on the performance of the ignition assembly. A flame sensor is provided for detecting and a sensing the existence of pilot flame and for controlling the gas flow to the burners accordingly.

4 Claims, 3 Drawing Sheets

PILOT ASSEMBLY FOR DIRECT FIRED MAKE-UP HEATER UTILIZING IGNITER SURROUNDED BY PROTECTIVE SHROUD

FIELD OF THE INVENTION

The present invention relates to air heating devices and, more particularly, to an improved pilot ignition assembly for a direct fired make-up air heater.

BACKGROUND OF THE INVENTION

In the field of heating and air conditioning, it has long been known that the use of exhaust vents frequently creates negative pressure within the heated building, unless adequate provisions are made to provide a sufficient supply of outside air to compensate for the exhaust discharge. This problem is frequently experienced in industrial plant settings, where negative pressure within the building can result in various problems such as backdrafts in flues and ventilators, excessive drafts through doors and windows, and dispersal of contaminants throughout the building. A common solution to the problem is the use of make-up heaters, which provide an inflow of fresh air heated to a desired delivery temperature roughly equivalent to the comfort level for the space heating system in the building.

Make-up heaters are frequently gas fired, having a plurality of burners disposed upstream of a squirrel cage blower or other type of fan. Cold outside air is drawn over the burners and heated to the desired temperature, then discharged into the building by the blower. A typical electronic ignition system incorporated in a conventional make-up heater includes a spark generator and a spark plug disposed in the vicinity of the burners. With traditional spark systems, the spark is generated in mid-air, making it very susceptible to air and gas velocity which tend to extinguish the spark. Furthermore, the electrodes on conventional spark plugs may become warped with extended usage and deteriorate over time, rendering the spark and its location unreliable for efficient ignition. The problems with conventional spark plugs are compounded when the system is used in extremely cold and/or moist air. Accordingly, it has been found highly desirable to devise an ignition assembly for use in make-up air heaters which solves the aforementioned problems which may be encountered in conventional spark systems.

SUMMARY OF THE INVENTION

It is an object of the present invention to provide an ignition system for use in make-up air heaters which provides superior performance over spark-generating ignition systems.

It is another object of this invention to provide such an ignition assembly which is less affected by extremely cold outside air temperatures than conventional ignition systems.

It is a further object to provide an ignition system which is less affected by the humidity of the outside air.

A still further object is to provide a simple, reliable, and relatively inexpensive ignition system for make-up air heaters.

In order to achieve these and other objects, the present invention comprises an ignition assembly for a direct fired make-up air heater having at least one burner disposed therein for heating an incoming supply of cold air. The ignition assembly includes a pilot tube disposed adjacent the burner, having an open end in communication with the gas source and a discharge end comprising a plurality of discharge ports. The ignition assembly further includes an electric heating element disposed adjacent the discharge ports of the pilot tube, operative to ignite gas discharged through the discharge ports to produce a pilot flame for igniting the burner. A wind-resisting tubular shroud surrounds the heating element to provide protection from the incoming cold air, thereby insuring that a suitable temperature is reached for efficient ignition of the pilot flame. In a preferred embodiment of this invention, the pilot tube, heating element, wind resisting shroud, and a flame sensing probe are mounted to a plate, thereby comprising a modular ignition assembly for simplified installation.

The above stated and other objects of this invention will become apparent upon reading the following detailed description, taken in conjunction with the appended drawings.

DETAILED DESCRIPTION OF THE PREFERRED EMBODIMENT

Figure 1:
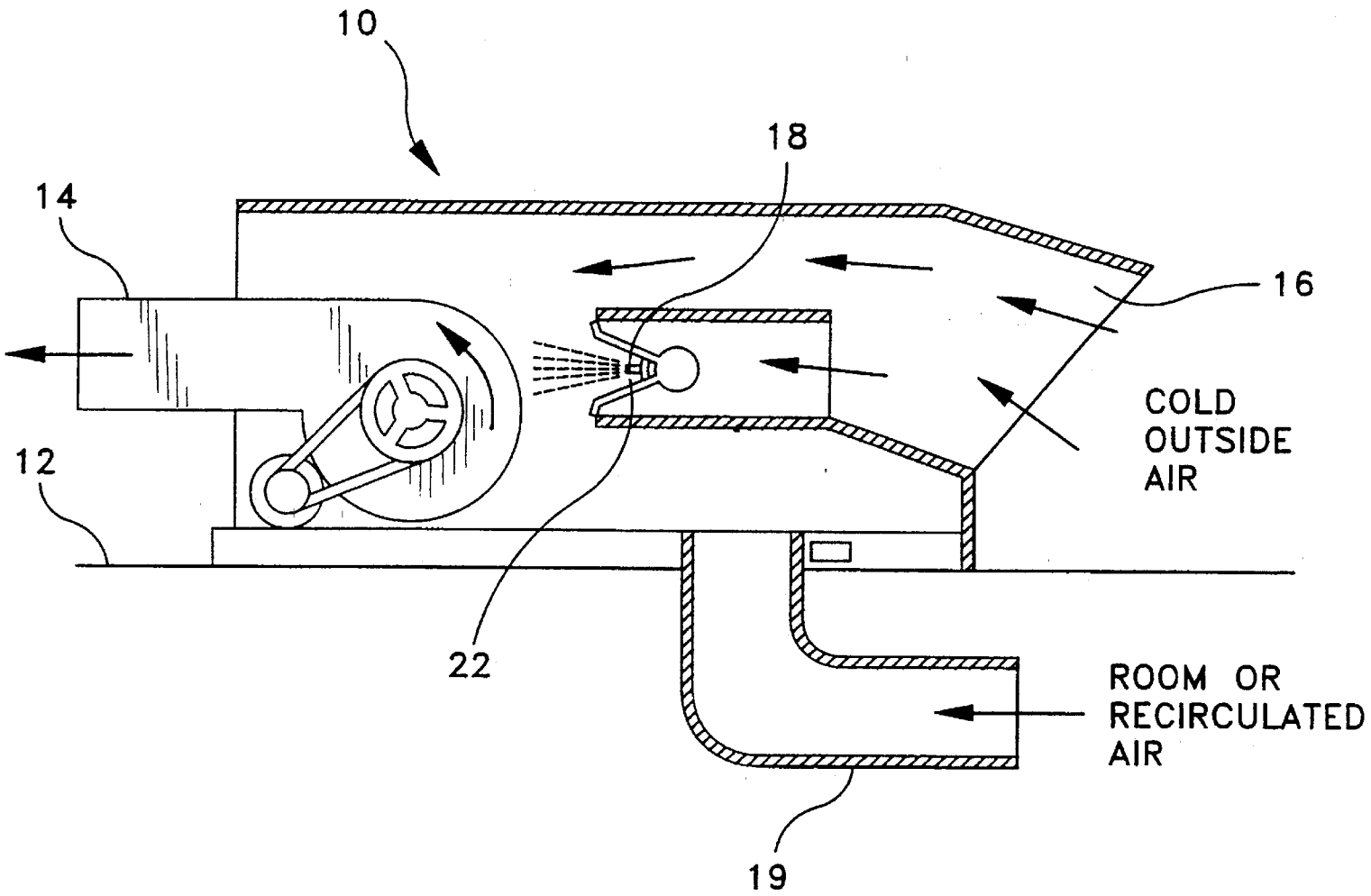
FIG. 1 is a side sectional schematic view of a typical direct fired make-up air heater incorporating the principles of this invention.

Referring initially to FIG. 1, a generally conventional direct fired make-up air heater 10 is shown mounted to the roof 12 of a building. Blower 14 draws cold outside air in through air intake 16, draws the air over burners 18, and discharges the air through conventional ductwork into the building. Room or recirculated air is drawn into blower 14 through a duct 19. The ductwork details are not shown for the sake of clarity, since they are conventional and well known to those skilled in the art. Ignition assembly 20, discussed more fully below, is located in area 22 adjacent burners 18. It is to be understood that, with the exception of unique ignition assembly 20, the remainder of heater 10 is conventional. Accordingly, various aspects of heater 10 are not discussed herein for the sake of brevity, but will be fully understood by those skilled in the art.

Figure 2:
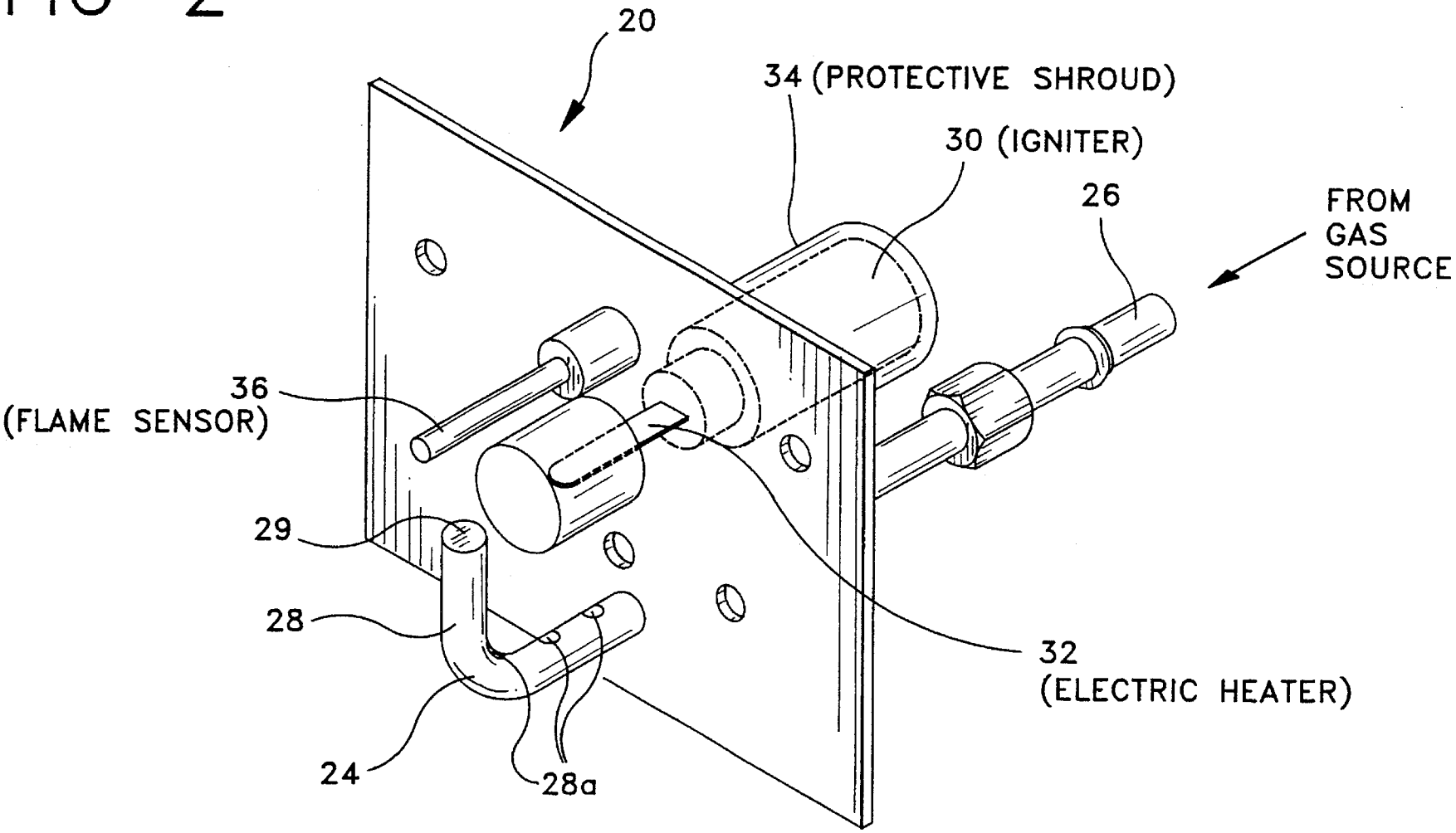
FIG. 2 is a top side perspective view of the ignition assembly of this invention.
Figure 3:
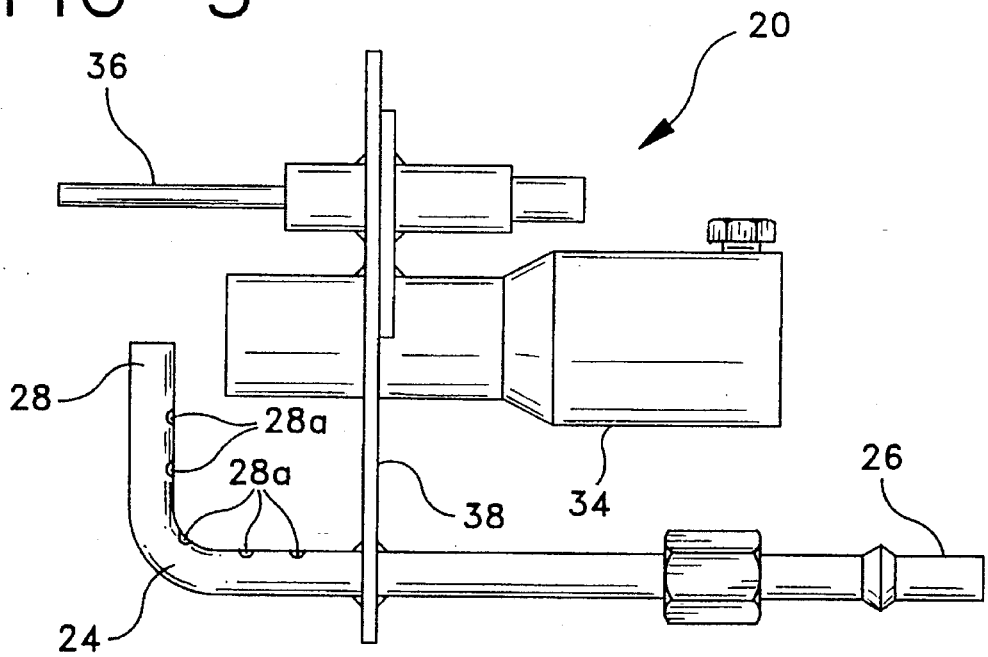
FIG. 3 is a side perspective view of the ignition assembly shown in FIG. 2.
Figure 4:
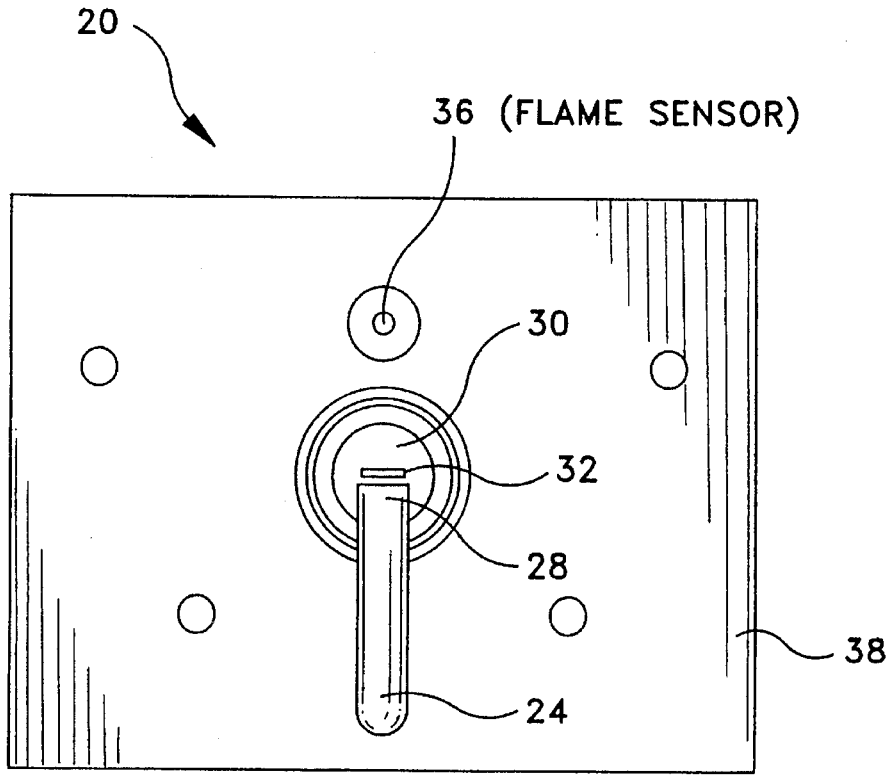
FIG. 4 is a front perspective view of the ignition assembly shown in FIGS. 2 and 3.

Referring now to FIGS. 2–4, ignition assembly 20 is seen comprising an L-shaped pilot tube 24 having an open connection end 26 and a discharge end 28. The distal end 29 of tube 24 is closed by a suitable plug or soldered cap. Discharge end 28 comprises a series of ports **28*a* communicating with the interior of tube 24. Although in the preferred arrangement there are five ports 28*a*, any number of ports suitable for the particular application may be used. Also, it should be noted that in the preferred form, discharge ports 28*a* extend interiorly around the right angle bend of the L-shaped tube 24, with some of such ports 28*a* being parallel to and others being perpendicular to the heating element 32**.

When installed in heater 10, connection end 26 is operatively connected to the supply of combustible gas, such as natural gas or propane, used to fuel burners 18. A hot surface igniter 30 is disposed above pilot tube 24, with heating element 32 extending longitudinally towards discharge end 28 and above ports **28*a*. In the preferred embodiment of this invention, hot surface igniter 30 is a model 401E miniigniter manufactured by the Norton Company of Worcester, Mass., capable of generating temperatures in the range of 2200°–2400° F. Accordingly, igniter 30** provides a significantly higher temperature for igniting the pilot flame than the 1700°–1900° F. generated by conventional spark systems.

Another unique aspect of ignition assembly 20 is shroud 34, which substantially surrounds igniter 30 and heating element 32. The tubular body of shroud 34 shields heating element 32 from the adverse effects of extremely cold outside air drawn in by blower 14 at a relatively high velocity, which would otherwise tend to lower the ignition temperature generated by heating element 32. Shroud 34, in conjunction with the comparatively high temperatures generated by igniter 30, make ignition assembly 20 significantly less susceptible to the effects of incoming air velocity, extreme low temperatures, and high humidity than conventional spark ignition systems.

Ignition assembly 20 preferably includes a flame sensor 36 disposed adjacent and above discharge ports 28*a* of pilot tube 24. Operating in a generally conventional manner, sensor 36 detects the existence of a pilot flame at discharge ports 28*a* and generates a signal responsive thereto. As those skilled in the art will readily understand, the signal generated by sensor 36 may be used to control a valve in the gas supply line leading to the burners 18, so that gas is not discharged in the absence of a pilot flame. Finally, it is preferred that pilot tube 24, igniter 30, shroud 34, and sensor 36 all be mounted on a plate 38 as shown so that assembly 20 comprises a modular unit that is relatively easy to install in a heater 10.

While the principles of an improved ignition assembly for use with a direct fired make-up heater have been shown in the foregoing detailed description, it will be apparent to those skilled in the art that various modifications of the preferred embodiment described herein may be made without departing from the spirit and scope of this invention. Accordingly, the true scope of the invention shall be limited only by the following claims.

What is claimed is:

1. An ignition assembly for a direct fired make-up air heater, said heater having at least one burner disposed therein for heating an incoming supply of cold air, said burner operatively communicating with a source of combustible gas, said ignition assembly comprising:

a pilot tube disposed adjacent said at least one burner, having an open end in communication with said gas source and a gas discharge end, said pilot tube being L-shaped and said open end being oriented at a substantially right angle relative to said discharge end, said discharge end comprising plural discharge ports disposed around the right angle bend of said L-shape pilot tube;

an electric heating element disposed adjacent said discharge ports, operative to ignite gas discharged through said ports to produce a pilot flame; and wind resisting means surrounding at least a portion of said heating element for protecting said heating element from said incoming supply of cold air.

2. The ignition assembly of claim 1, further comprising:

flame sensing means disposed adjacent said discharge end of said pilot tube, operative to detect the existence of said pilot flame and generate a signal responsive thereto.

3. The ignition assembly of claim 1, wherein:

said wind resisting means comprises a tubular body portion disposed longitudinally about said heating element.

4. The ignition assembly of claim 1, wherein:

said pilot tube and said heating element are secured to a mounting plate separable from said heater.

* * * * *